United States Patent [19]

Hilfiker et al.

[11] Patent Number: 4,580,117

[45] Date of Patent: Apr. 1, 1986

[54] MOTOR PROTECTION SWITCH

[75] Inventors: Peter Hilfiker, Buchs; Ladislav Mirocha, Lostorf, both of Switzerland

[73] Assignee: Sprecher & Schuh AG, Aarau, Switzerland

[21] Appl. No.: 531,435

[22] Filed: Sep. 12, 1983

[30] Foreign Application Priority Data

Sep. 28, 1982 [CH] Switzerland ..... 5699/82

[51] Int. Cl.[4] ..... H01H 73/12; H01H 75/00; H01H 77/00

[52] U.S. Cl. ..... 335/17; 335/23; 337/72

[58] Field of Search ..... 335/17, 23, 35, 173, 335/174; 361/115.45; 337/72, 70, 78

[56] References Cited

U.S. PATENT DOCUMENTS

| | | | |
|---|---|---|---|
| 4,081,852 | 3/1978 | Coley et al. | 361/45 |
| 4,090,158 | 5/1978 | Oeda | 335/17 |
| 4,382,270 | 5/1983 | Davidson et al. | 361/115 |

*Primary Examiner*—Harold Broome
*Attorney, Agent, or Firm*—Ladas & Parry

[57] ABSTRACT

A rocking beam is movable into an "on" and an "off" position by actuating means which actuate linkage means and work against the force of a spring urging the beam into an intermediate trip-position. Through a guide surface the beam actuates a toggle assembly composed of two toggle levers linked by a toggle joint and having distal joints linked with a contact actuating lever and a pawl lever, respectively. When the pawl lever is restrained by the ratchet, the movement of the toggle joint caused by moving the actuating means into the "on" or "off" position results only in the opening and closing of contacts through a movement of their actuating lever. A readiness for switching on can be obtained by resetting the actuating means from the trip-position into the "off" position. If the switch is "on" and the pawl is released by the overload current trigger, then the spring can move the beam together with the actuating means into the intermediate, or trip, position, while a spring opens the contacts by operating the actuating lever. If the switch is released through the action of the short circuit trigger, then a toggle is also tripped and an external display becomes visible. It remains so until the toggle is reset by putting the actuating means into the "off" position. The switch can be reset by the same simple action.

7 Claims, 4 Drawing Figures

MOTOR PROTECTION SWITCH

BACKGROUND OF THE INVENTION

1. Field of the Invention

The invention relates to a motor protection switch with a frame, at least one movable contact piece which is movable against a spring load into an "on" position and back into an "off" position by way of a manually operated actuating means and through linkage means which are arrested by a pawl in the "on" position in such a way that when the pawl is released, either by an overload current trigger or by a short circuit trigger, the linkage means can take up a trip-position, and with external display means which give an external indication wherever a short circuit has occurred.

2. Description of the Prior Art

Such a switch is described in the U.S. Pat. No. 4,090,158. It has the drawback that it cannot be ascertained whether the switch was actuated through an overload current, i.e. even when the switch was actuated by an overload current, one can only see from the outside that the switch is in the "on" position. One is then forced to make a trial with the motor at rest, which is both of doubtful value and cumbersome in the case of a switchboard and/or remote control. A reset into the operating state can be achieved by switching out and then switching on again. When the switch was actuated by a short circuit, it again remains externally in the "on" position, apart from a special external display. Here, too, a resetting requires first a switch-off movement of the manual control. But switching on is only possible after one has reset the external display. Considering that as a rule a release through a short circuit is rather rare, this operation can be cumbersome, even for persons who are in principle conversant with the operation.

It is also known to use motor protection switches as described in the U.S. Pat. Nos. 3,935,409 and 4,163,881, in which a release due to any cause (that is, either a release due to overload current or one due to a short circuit) will lead to a trip-position of the manual actuating means which can be recognized from outside. This is dangerous because, not knowing the reason for the release, one may perform a reset even when there was a short circuit, without first removing the reason for the short circuit. This can have far-reaching consequences.

SUMMARY OF THE INVENTION

The invention aims at providing a motor protection switch which can be manufactured economically and functions securely, and whereon it can be ascertained with certainty from outside, in which operating state the switch is at any given moment, and whether it was released through a short circuit or through an overload current. In both cases the resetting operation shall be possible by the same, simple operation.

In order to fulfill these aims the invention proposes a motor protection switch as defined in claim 1. In this switch the actuating means can take up a position which corresponds to a trip-position of the linkage means and is ascertainable from outside. When there is no external display, this trip-position indicates that the switch was triggered through a current overload, whilst said position together with an external display indicates that the switch was triggered by a short circuit. The switch is so constructed, that after it has been triggered, the linkage means, and also the external display if it was actuated, can both be put into the ready state for a subsequent switch on by moving the actuating means into the "off" position. Thereafter the switch can be reset into the "on" position by operating the actuating means.

It can thus be ascertained by looking at the switch from the outside, whether it is in the out, in, or trip-position. If the actuating means are in the trip-position and no external display is observable, then an overload current release has taken place. After the bimetal element, which is known per se, has cooled off, the switch can be put into readiness for switching on by moving the actuating means from the trip-position into the out position. Thereafter it is possible to switch on again.

However, if the trip-position of the actuating means is due to a short circuit, then the external display is visible, too. One then knows that the reason for the short circuit must be removed before attempting to switch on again. Simply moving the actuating means from the trip-position into the out position allows to obtain a readiness for a switch-on operation. Thereby the external display is also returned to its rest position. It is then possible to switch on again.

The invention thus allows to obtain clear indication of the operating state, in a simple way and at remarkably low costs.

Preferably, there is provided a rocking beam connected to the linkage means, which beam is connected with a spring urging the beam into its middle, or trip-position. The spring is tensioned by switching on or off, whereby the beam swings into one or the other direction.

If a release takes place when the switch is in the "on" position, then the spring can bring the beam back into the trip-position, whereby the actuating means is also brought back into that position. If needed, further elements of the linkage means can also be brought back into the trip-position by the beam.

Thus the beam can be used to bring the actuating means into the trip-position.

In order to lock the switch when it has not been released, knee-, or toggle joints are preferably used where both arms of the toggle are so connected through a toggle joint, that the assembly will lock into either of two angled positions which lie on either side of a straight position. One of the angled positions then is the "off" position, and the other is the "on" position. Both positions can be attained through corresponding movements of the toggle joint.

The free end of one toggle arm is preferably connected through an end joint with a contact actuating lever that can swing around a rocker bearing, whilst the free end of the other arm is connected through an end joint with a locking lever which can swing in another rocking bearing. Both end joints are so arranged that for any position of the linkage a straight line drawn from one joint to the other will lie between the "on" and the "off" position of the toggle joint. Therefore, a reset into the "on" position after the "off" position has been attained is only possible when the pawl has been engaged with its corresponding lever during the switch-off movement.

Preferably, the toggle joint is guided by a guide which runs transversely to its switching movement and is actuated through a push rod connected to the beam through a linkage.

It can thus be achieved that the toggle joint takes into account the different operation states by a movement which runs from its "on" position laterally along the guide. When the switch is tripped and the pawl is disengaged, the toggle joint together with the push rod and the beam can be moved into the trip-position by the spring which acts on the beam, whilst the contact actuating lever swings into its "off" position and separates the contacts.

This happens independently of the reason for the tripping. It is not possible to switch on again, before the actuating means together with the beam, and thus also the push rod, has been brought into the "off" position, whereby the push rod moves the toggle joint into its "off" position. As the contact actuating lever then is already in its "off" position, in which it may be resiliently maintained, the movement of the toggle joint from the trip-position into the "off" position will result in moving the pawl lever into its locking position, in which it can be again engaged by the pawl. Of course, a removal of the short circuit or a cooling off delay after an overload current release is necessary.

However, if the switch was tripped by a short circuit, then the external display will also become visible. This does not basically modify the resetting operation, but it gives a distinct warning.

It is advantageous to connect the external display with a bistable toggle device, which is so arranged that only the short circuit release means may move the toggle device from its rest position into its display position. This entails that the external display remains in its rest position until a release through a short circuit takes place, but also that after the toggle device has been tilted into its display position, the external display will remain in its warning position until the toggle device has been brought back into its rest position. This operation will preferably be obtained by moving the actuating means from the trip-position into the "off" position. Thereby the readiness for switching on again is obtained, as previously described. The actuating means or a part of the linkage means can in this case be so arranged, that a mechanically active connection is obtained only when the toggle device is reset from its display position as just described. This can be achieved rather simply. A preferred solution to this problem is shown in the drawing.

The invention will now be illustrated with reference to the schematic drawing.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF EMBODIMENTS

Figure 1:
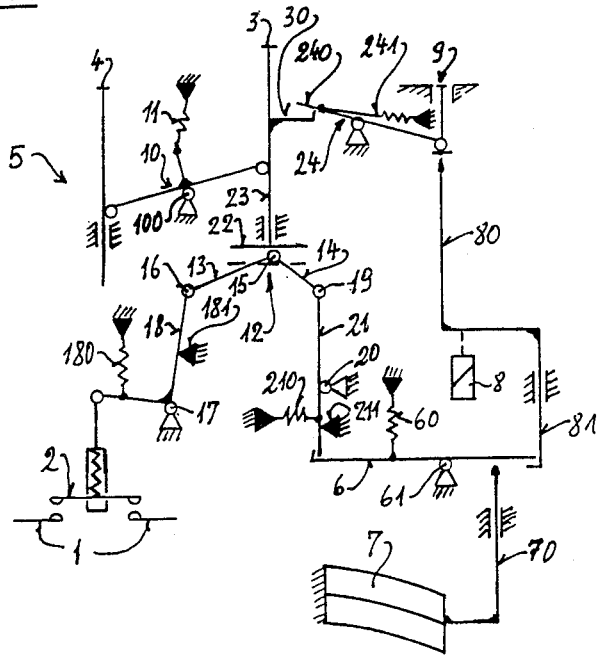
FIG. 1 shows a motor protection switch of the invention in the "off" position.

In the drawings the frame of the motor protection switch is hinted at by triangles hatched in one direction, which represent resting points, and by parallel lines which are doubly hatched on the outside and indicate gliding guides or fences fixed to the frame. Joints are indicated by circles.

The motor protection switch which is shown has a pair of resting contacts 1 which are connected to incoming conductors, and a pair of contacts 2 which are movable with respect to the former.

For the purpose of normal switch on and switch off operations, actuating means are provided in the form of a pair of push buttons, with a "switch-on" button 3 and a "switch-out" button 4, which both act on a linkage system 5.

A beam 10 is journalled on the frame at the point 100, and can be actuated by the push buttons 3, 4. A beam spring 11 urges the beam into its middle position (which corresponds to its trip-position in FIGS. 3 and 4). The rocking beam 10 is connected with the toggle joint 15 and the toggle levers 12 through the action of a push rod 23 and the sliding guide 22 fixed to said push rod.

Figure 3:
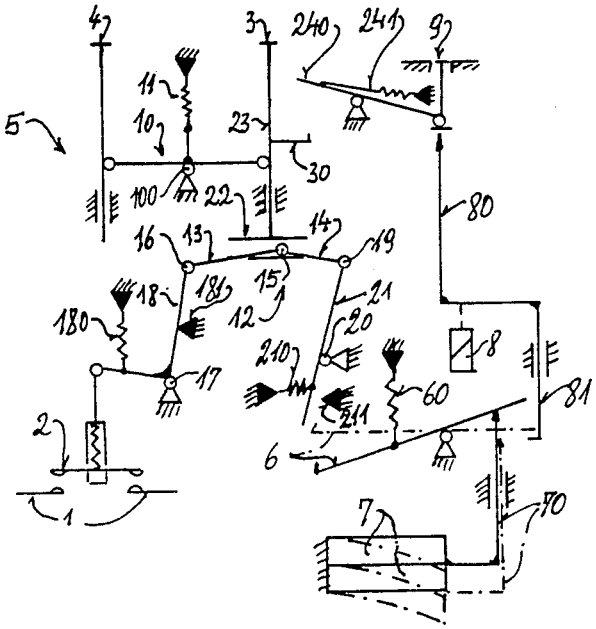
FIG. 3 shows this motor protection switch in the trip-position due to an overcurrent release.
Figure 4:
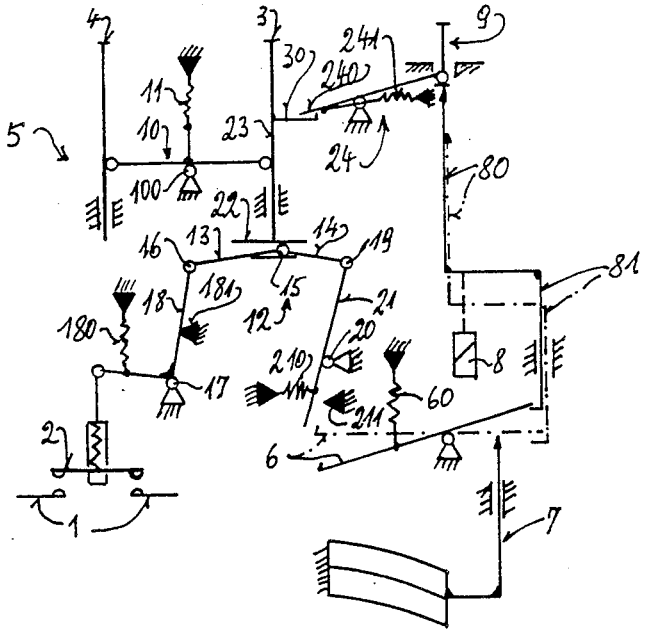
FIG. 4 shows this motor protection switch in the trip-position caused by a release due to a short circuit.

The lever 13 of the toggle assembly 12 is connected by an end joint 16 with the angled contact actuating lever 18. The contact actuating lever 18 is journalled on a rocker bearing 17 and is urged by the spring 180 against the stop 181, in a position in which the contacts 1, 2 are separated (FIGS. 1, 3 and 4).

The arm 14 of the toggle assembly 12 is connected through a joint 19 with the pawl lever 21. This pawl lever 21 is journalled on the frame through the rocker bearing 20 and is maintained in the engaged position (FIGS. 1 and 2) through the pawl 6, against the urge of the spring 210; the pawl lever is thus maintained against or near the stop 211.

The overload current trigger 7 is sketched in the form of a bimetal element which can actuate the pawl 6 through a push rod 70, without thereby moving the releasing linkage 81 of the short circuit triggering device 8.

The short circuit triggering device 8 is represented as an electromagnetic relay, the armature of which actuates the rods 80, 81 when a short circuit current occurs. The actuating rod 81 can thus disengage the pawl 6 without moving the push rod 70 of the overload current triggering device 7. The display rod 80 of the short circuit triggering device 8 is represented as a push rod, which loosely rests against the outer display 9 (which it can thus only push, but not pull).

The outer display 9 is functionally connected with the rocking lever 240 of the bistable toggle device 24 which is maintained in the rest position (FIGS. 1 to 3) or in the display position (FIG. 4) by the toggle spring 241. The rocking lever 240 can be reset from the display position (FIG. 4) into the rest position (FIG. 1) by the resetting element 30 of the linkage means 5, when one switches from the trip-position into the "off" position.

Figure 2:
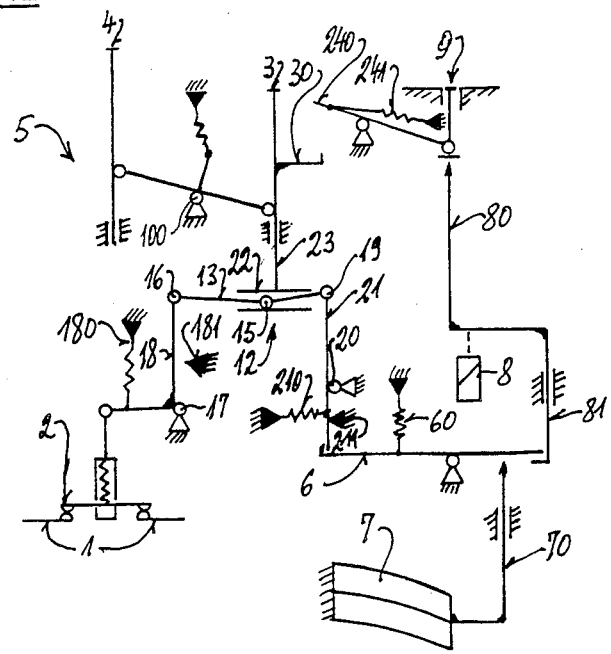
FIG. 2 shows this motor protection switch in the "on" position.

The motor protection switch can be switched from the "off" position (FIG. 1) into the "on" position (FIG. 2) by pressing the "on" button 3, whereby the linkage system 5 is brought from the "off" position shown in FIG. 1 into the "on" position shown in FIG. 2. Thereby the rocking beam 10 is tilted clockwise and the toggle assembly 12 is moved from its angled "off" position through the straight position (not shown) into its angled "on" position, in which it remains. Because the toggle assembly 12 is maintained through its toggle joint 15 within the sliding guide 22, and is hinged through the outer joint 19 on the pawl lever 21 which is maintained immobile (between the stop 211 and the pawl 6), only the contact actuating lever 18 moves, together with the contacts 2.

Contrariwise, the switching off is obtained through a pressure on the "off" button 4, whereby the system is moved from the "on" position of FIG. 2 into the "off" position of FIG. 1.

If now the motor protection switch is in the "on" position shown in FIG. 2, then it can be triggered and brought into one of the two trip-configurations shown in FIGS. 3 and 4.

Release through overload current (FIG. 3): An overload current heats up the overload triggering device 7, which disengages the pawl 6 against the force of the spring 60 through a push rod 70. After the overload current triggering device 7 has cooled down (its current is interrupted by the release), the pawl 6 is pulled back by the spring 60 into its rest position. The trip-position of the push buttons 3, 4 (without external display 9) shows that an overload current has occurred. Thus the disengaged pawl lever 21 can be brought back through the spring 210 from the engaged position shown in FIG. 2 into the released position shown in FIG. 3. Thereby the outer joint 19 is displaced towards the right and the spring 11 can pull, through the action of the push rod 23, the rocking beam 10 into the trip-position. Indeed, the arms of the toggle assembly 12 are now not maintained by the outer joint 19 anymore. The spring 180 can thus pull the contact actuating lever 18 together with the contacts 2 into the "off" position, as the contact actuating lever 18 now is not supported at the outer joint 16.

Resetting into the ready position: The out position of the whole linkage system can be reset by actuating the "out" button, whereby the pawl lever 21 is again pulled by the toggle assembly 12 and through the outer joint 19 into the engaged position. The contact actuating lever 18 rests against the stop 181, so that the outer joint 16 cannot be pulled to the right. The lift of the toggle joint 15 through the sliding guide 22 exerts a pull onto the arm 14, which transmits this pull through the outer joint 19 onto the pawl lever 21. The motor protection switch is ready for switch-on!

Triggering through a short circuit (FIG. 4): When a short circuit occurs, this activates the short circuit triggering device 8 and results in a movement of the pawl actuating linkage 81 and the disengagement of the pawl 6. Thereupon follows the operation which has been already described. But in this case the short circuit triggering device 8 has also actuated the display actuating rods 80, which lifted the outer display 9 and simultaneously tilted the toggle device 24 further than its neutral position. Although immediately after the triggering of the short circuit triggering device 8 (its current is interrupted by the triggering), this device will return into its rest position, the outer display means 9 and the toggle device 24 will remain in the display position.

The trip-position of the two actuating means 3, 4 (both push buttons 3 and 4 are at the same height) and the outer display show that a short circuit triggering has occurred. One realizes immediately that one shall not switch on again before the cause of the short circuit has been removed.

Once the short circuit has been removed, one can perform the same operations as previously described under the heading "Resetting into the ready position". Through this operation the resetting element 30 will act upon the rocking lever 240 and thus reset the toggle device 24 and the external display 9 into their rest position.

The position "ready for switching on" corresponds to the "off" position of FIG. 1.

It has thus been shown, how the construction of a motor protection switch according to the invention can be very simple and yet safe. Of course one may not only construct a single-phase motor protection switch in the described manner, but also a multiphase motor protection switch. In this case single triggering devices can be replaced by sets comprising one triggering device for each phase.

While there are shown and described present preferred embodiments of the invention, it is to be distinctly understood that the invention is not limited thereto, but may be otherwise variously embodied and practiced within the scope of the following claims.

Accordingly, what is claimed is:

1. A motor protection switch with a frame and at least one contact piece which is movable relatively to at least one resting contact piece, the movable contact piece being movable against the urge of a spring into an "on" position and back into an "off" position by way of a manually operated actuating means and through linkage means which are locked by a pawl in the "on" position in such a way that when the pawl is released, either by an overload-current trigger or by a short circuit trigger, the linkage means will take up a trip-position, and with external display means which give an external indication whenever a short circuit has occurred, comprising in combination: a rocking beam being urged by a spring into a middle position which corresponds to the trip-position of the linkage means, the actuating means being arranged to rock the beam seesaw-like to any side of said middle position against the force of the spring, either into the "on" position or into the "off" position, and that the beam is functionally connected with the actuating means and the linkage means, actuating means being actuable by a trip-position of the linkage means to indicate from outside in this trip-position a triggering through current overload, said actuating means being actuable together with an external display to indicate a triggering due to a short circuit, the linkage means, and if applicable the external display, can be reset for a switch-on by moving the actuating means into the "off" position against the force of a beam spring and said spring, and that the "on" position can thereafter be reset by operating the actuating means.

2. Motor protection switch according to claim 1, characterized in that the linkage means comprise a toggle assembly with two toggle levers linked by a toggle joint, each having an outer joint, whereby the toggle joint can only be brought from an "off" position (FIG. 1) where the toggle assembly is angled in one direction, through a stretched position into a locked off position (FIG. 2) where it is angled in the opposite direction, when the linkage means is in a ready state (FIG. 1).

3. Motor protection switch according to claim 2, characterized in that one outer joint is linked to a contact-actuating lever hinged on a rocker bearing attached to the frame, and that the other outer joint is linked to a pawl lever hinged on a rocker bearing, the arrangement being such that a straight line drawn from one outer joint to the other always lies between the "off" position (FIG. 1) and the "on" position (FIG. 2) of the toggle joint.

4. Motor protection switch according to claim 3, characterized in that the toggle joint is guided by a guide fence connected to a rod system which is itself linked to the beam.

5. Motor protection switch according to claim 1, characterized in that the external display is linked to a bistable toggle device which can only be tilted from its resting position (FIGS. 1 to 3) to its display position (FIG. 4) by the action of the short circuit tripping device, and where the toggle device can be reset from its display position (FIG. 4) by moving the actuating means from the trip-position (FIG. 4) into the "off" position (FIG. 1).

6. Motor protection switch according to claim 1 wherein one outer joint is linked to a contact-actuating lever hinged on a rocker bearing attached to the frame, and that the other outer joint is linked to a pawl lever hinged on a rocker bearing, the arrangement being such that a straight line drawn from one outer joint to the other always lies between the "off" position and the "on" position of the toggle joint.

7. Motor protection switch according to claim 6, wherein the toggle joint is guided by a guide fence connected to a rod system which is itself linked to the beam.

* * * * *